US010236566B2

(12) United States Patent
Nishikawa et al.

(10) Patent No.: US 10,236,566 B2
(45) Date of Patent: Mar. 19, 2019

(54) ANTENNA DEVICES

(71) Applicants: KOJIMA INDUSTRIES CORPORATION, Toyota-shi, Aichi-ken (JP); TOYOTA JIDOSHA KABUSHIKI KAISHA, Toyota-shi, Aichi-ken (JP)

(72) Inventors: Kazuyoshi Nishikawa, Toyota (JP); Keita Yamagishi, Toyota (JP); Takashi Saito, Toyota (JP)

(73) Assignees: KOJIMA INDUSTRIES CORPORATION, Toyota-Shi, Aichi-ken (JP); TOYOTA JIDOSHA KABUSHIKI KAISHA, Toyota-Shi, Aichi-Ken (JP)

( * ) Notice: Subject to any disclaimer, the term of this patent is extended or adjusted under 35 U.S.C. 154(b) by 128 days.

(21) Appl. No.: 15/646,936

(22) Filed: Jul. 11, 2017

(65) Prior Publication Data

US 2018/0034142 A1 Feb. 1, 2018

(30) Foreign Application Priority Data

Jul. 29, 2016 (JP) ..... 2016-149133

(51) Int. Cl.
*H01Q 1/32* (2006.01)
*H01Q 1/12* (2006.01)
*H01Q 1/42* (2006.01)

(52) U.S. Cl.
CPC ..... *H01Q 1/3275* (2013.01); *H01Q 1/1214* (2013.01); *H01Q 1/42* (2013.01)

(58) Field of Classification Search
CPC ..... H01Q 1/1214; H01Q 1/42
See application file for complete search history.

(56) References Cited

FOREIGN PATENT DOCUMENTS

JP 2013229813 A 11/2013

*Primary Examiner* — Graham P Smith
(74) *Attorney, Agent, or Firm* — Conley Rose, P.C.

(57) ABSTRACT

A vehicular antenna device includes an antenna unit transmitting and receiving various electromagnetic waves or signals, an antenna cover configured to cover the antenna unit, and a pad configured to be attached to an inner peripheral surface of the antenna cover. The antenna unit is configured to be attached to the antenna cover with the pad disposed therebetween. The pad includes a plurality of pressure ribs formed in an inner surface of a peripheral wall thereof. The pressure ribs are configured to be pressed by the antenna unit being attached to the antenna cover in a condition in which the pad is partially displaced from a predetermined position relative to the antenna cover before the antenna unit is attached to the antenna cover.

6 Claims, 21 Drawing Sheets

ANTENNA DEVICES

CROSS-REFERENCE TO RELATED APPLICATIONS

This application claims priority to Japanese patent application number 2016-149133 filed Jul. 29, 2016, the contents of which are incorporated herein by reference in their entirety for all purposes.

STATEMENT REGARDING FEDERALLY SPONSORED RESEARCH OR DEVELOPMENT

Not applicable.

BACKGROUND

The disclosure relates generally to vehicular antenna devices. More specifically, the disclosure relates to vehicular shark fin antenna devices that are configured to be attached to a roof of a vehicle.

Generally, a vehicular antenna device is attached to a roof of a vehicle in order to increase the sensitivity of the antenna device. A known vehicular antenna device configured to be attached to the roof of the vehicle is taught, for example, by Japanese Laid-Open Patent Publication No. 2013-229813 (JP 2013-229813A). The antenna device may be referred to as a shark fin antenna. As shown in FIG. 14, the antenna device 103 includes an antenna unit 110 configured to transmit and receive various electromagnetic waves or signals, an antenna cover 130 covering or encapsulating the antenna unit 110, and an elastomer pad 140 attached to an inner peripheral surface 130*b* of an opening periphery 130*a* of the antenna cover 130. The antenna unit 110 is attached to the antenna cover 130 with the elastomer pad 140 disposed therebetween. The antenna device 103 thus constructed is attached to the roof of the vehicle with the elastomer pad 140 positioned between the antenna cover 130 and the roof. The antenna device 103 (the shark fin antenna device) may have a simple structure and a good appearance as compared with a (telescopic) rod antenna.

SUMMARY

In one aspect of the present disclosure, a vehicular antenna device may include an antenna unit transmitting and receiving various electromagnetic waves or signals, an antenna cover configured to cover the antenna unit, and a pad configured to be attached to an inner peripheral surface of the antenna cover. The antenna unit is configured to be attached to the antenna cover with the pad interleaved therebetween. The pad has pressure ribs that are formed in an inner surface of a peripheral wall thereof. The pressure ribs are arranged and constructed to be pressed by the antenna unit that is being attached to the antenna cover in a condition in which the pad is partially displaced from a predetermined position relative to the antenna cover before the antenna unit is attached to the antenna cover.

According to the aspect, when the antenna unit is pressed against the antenna cover in order to attach the antenna unit to the antenna cover in the condition in which the pad is displaced from the predetermined position relative to the antenna cover, the pressure ribs formed in the pad may be pressed by the antenna unit. As a result, the antenna unit may be attached to the antenna cover while the pad displaced from the predetermined position relative to the antenna cover may be returned to the predetermined position relative to the antenna cover. Thus, the vehicular antenna device may be prevented from being assembled in a condition in which the pad is partially displaced from the predetermined position relative to the antenna cover.

Other objects, features and advantage of the present teaching will be readily understood after reading the following detailed description together with the accompanying drawings and the claims.

BRIEF DESCRIPTION OF THE DRAWINGS

For a detailed description of the preferred embodiments of the invention, reference will now be made to the accompanying drawings in which.

DETAILED DESCRIPTION

Figure 1:
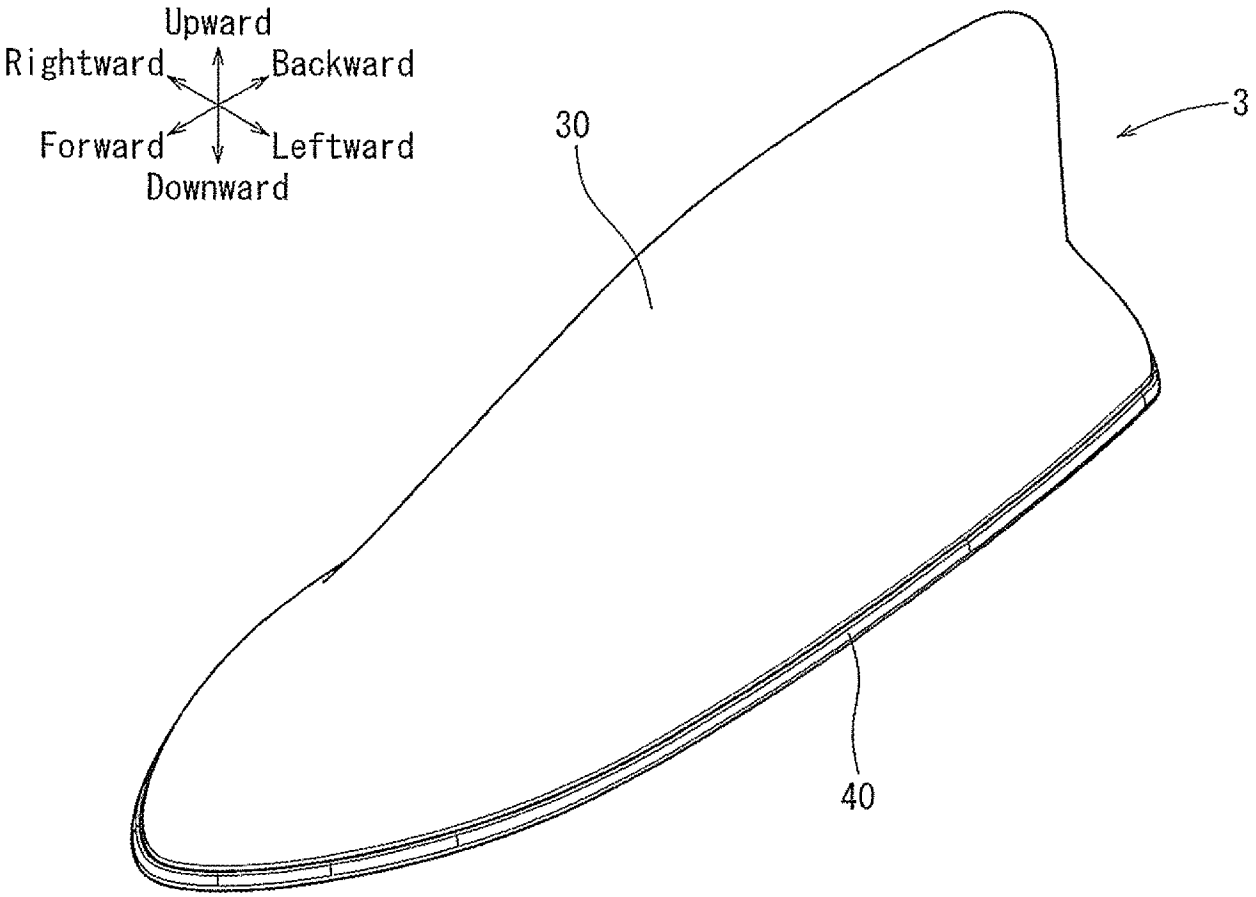
FIG. 1 is a perspective view of an antenna device according to a representative embodiment, which is viewed from above.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections.

Figure 14:
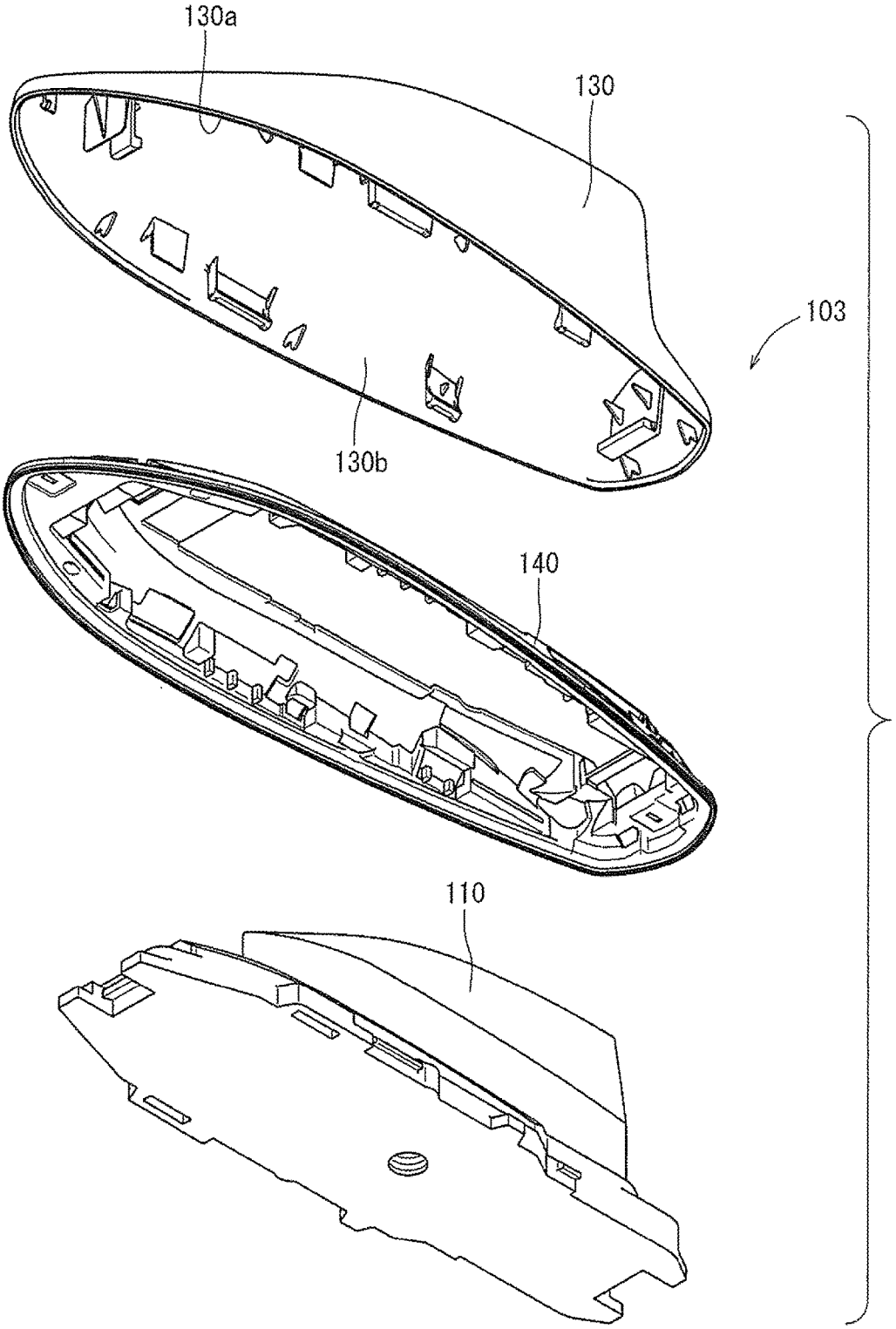
FIG. 14 PRIOR ART
FIG. 14 is an exploded perspective view of a conventional antenna device, which is viewed from below.
Figure 15:
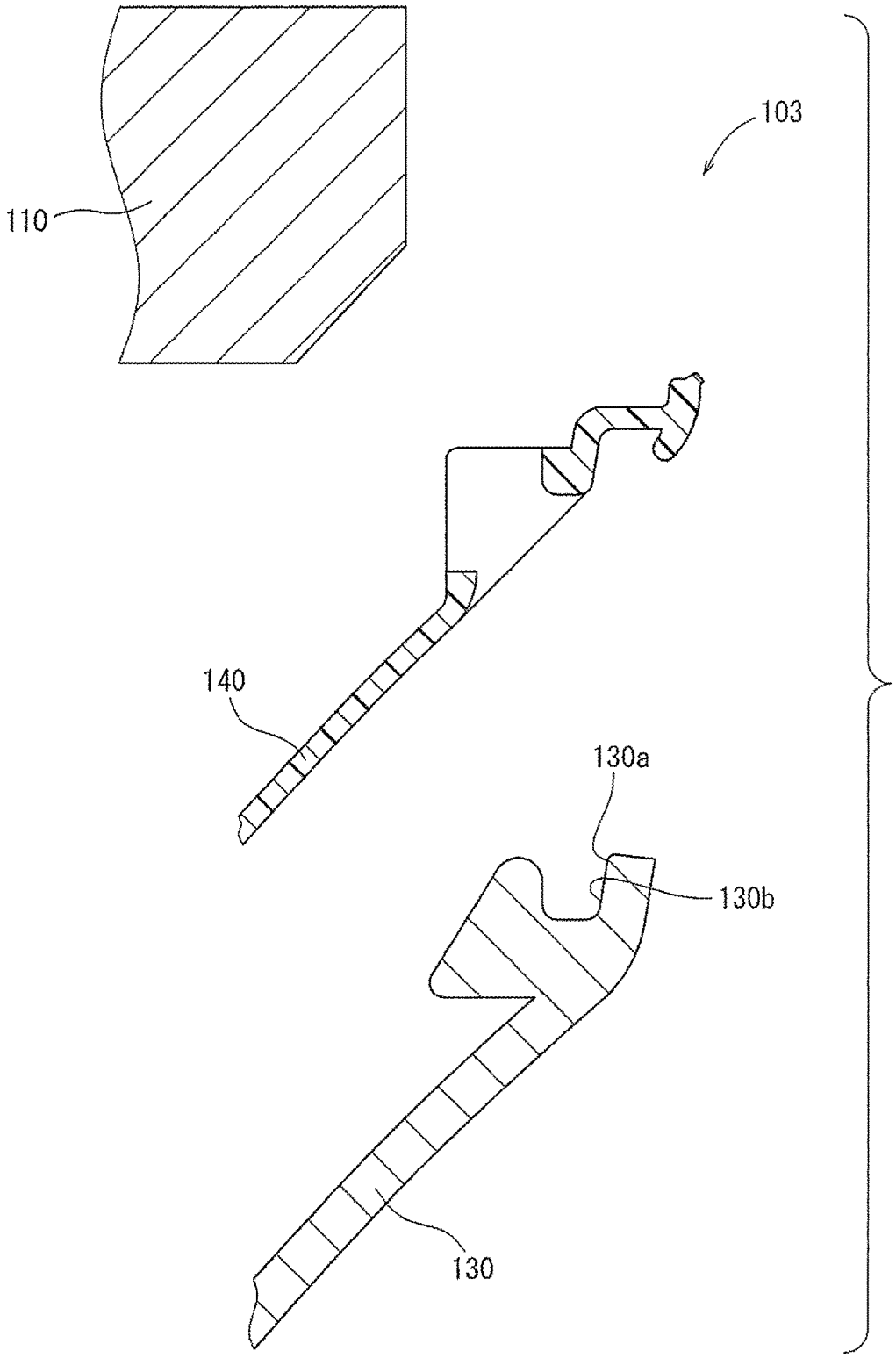
FIG. 15 PRIOR ART
FIG. 15 is a view similar to FIG. 4, which is an explanatory view showing a preinitiation stage of a first assembly operation in an assembly process of the conventional antenna device.
Figure 16:
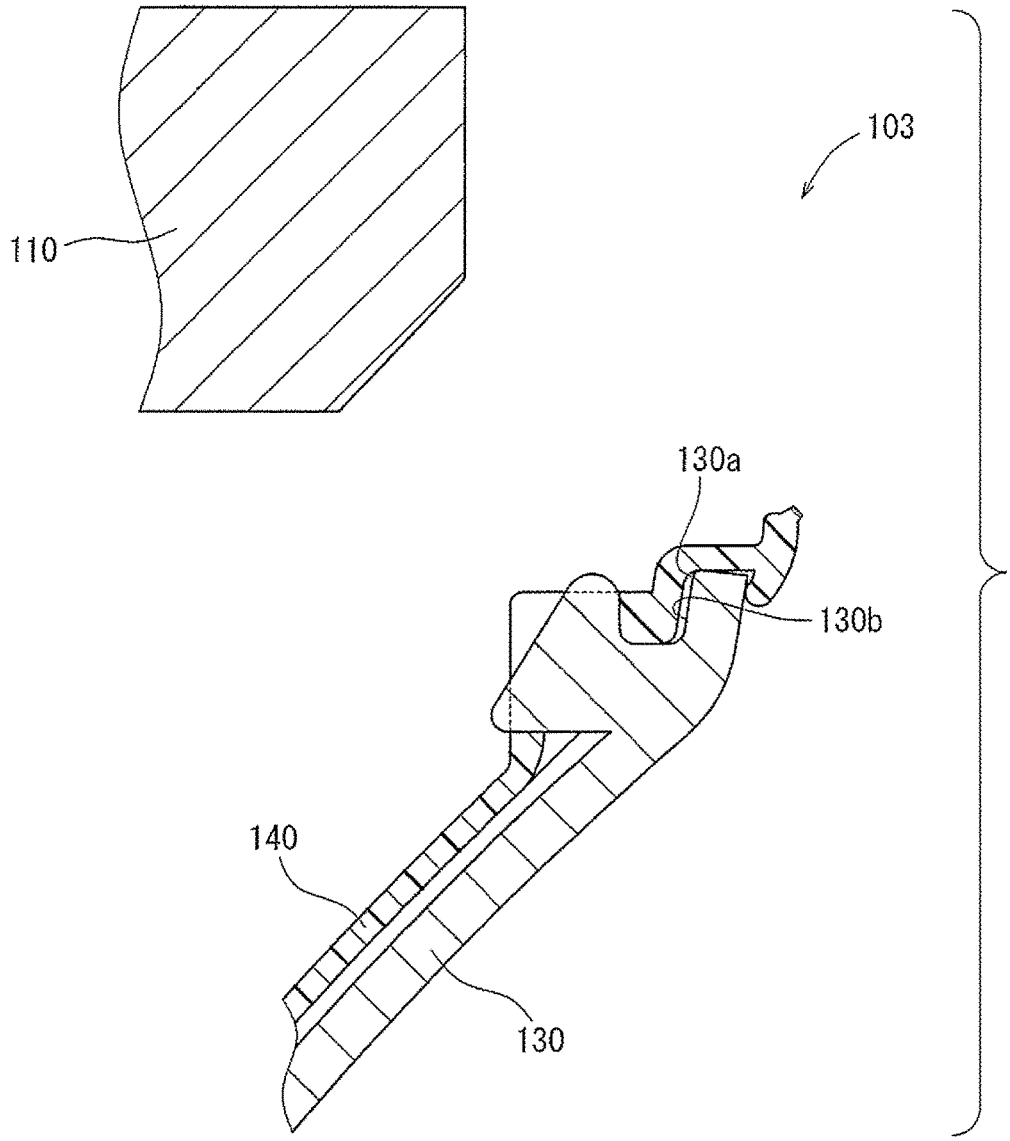
FIG. 16 PRIOR ART
FIG. 16 is a view similar to FIG. 5, which shows a completed stage of the first assembly operation (i.e., before the second assembly operation is started)
Figure 17:
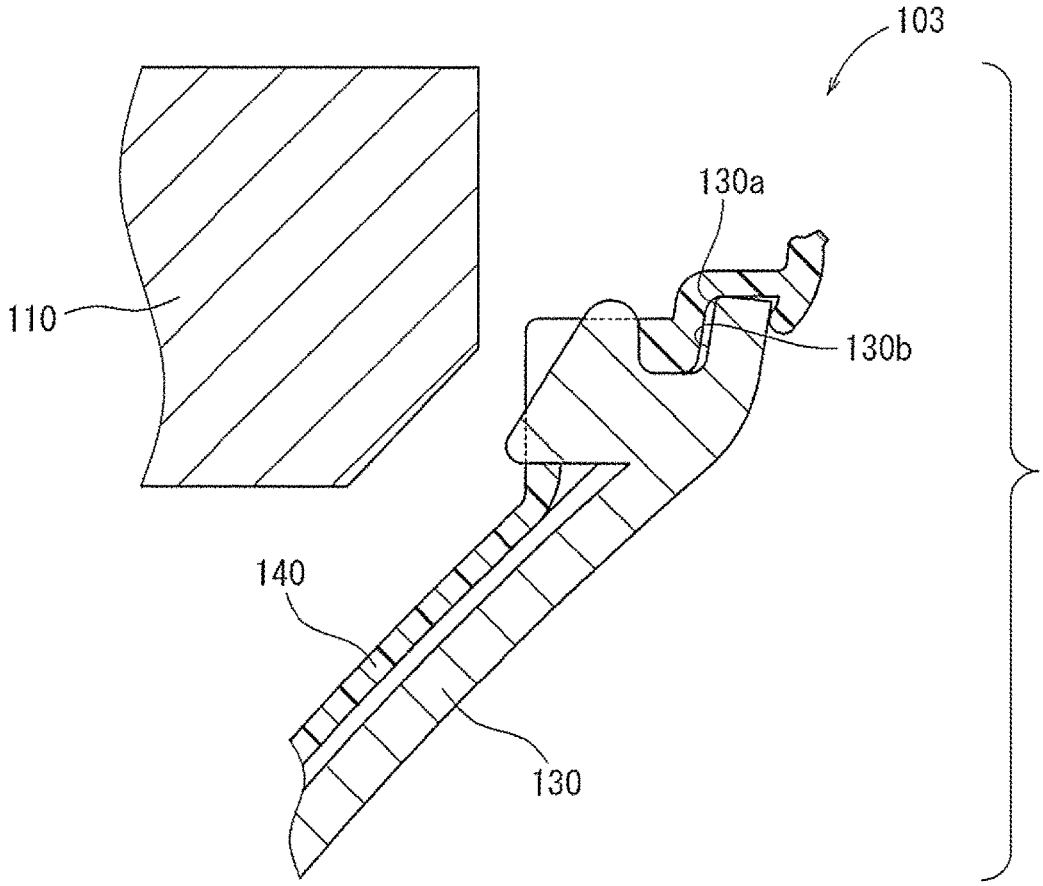
FIG. 17 PRIOR ART
FIG. 17 is a view similar to FIG. 6, which shows an initial stage of a second assembly operation in the assembly process of the conventional antenna device.
Figure 18:
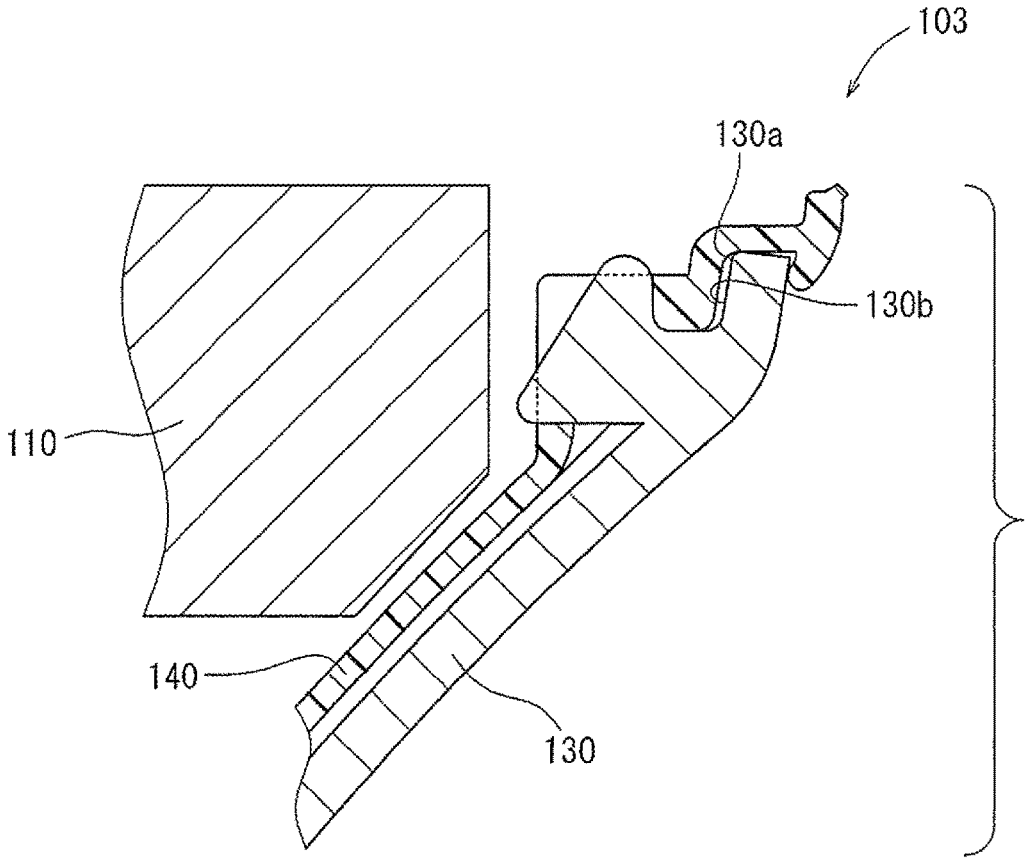
FIG. 18 PRIOR ART
FIG. 18 is a view similar to FIG. 7, which shows a completed stage of the second assembly operation.

As previously described, the conventional antenna device 103 shown in FIG. 14 includes antenna unit 110, antenna cover 130, and elastomer pad 140. In order to assemble the antenna device 103, the elastomer pad 140 is first fitted in or attached to the inner peripheral surface 130*b* of the opening periphery 130*a* of the antenna cover 130 (FIG. 15), which may be referred to as a first assembly operation or step. Thereafter, in this condition, the antenna unit 110 is attached to the antenna cover 130 (FIGS. 17 and 18) with the elastomer pad 14 disposed therebetween, which may be referred to as a second assembly operation or step. Thus, the antenna device 103 may be assembled through two assembly operations (the first and second assembly operations).

Figure 19:
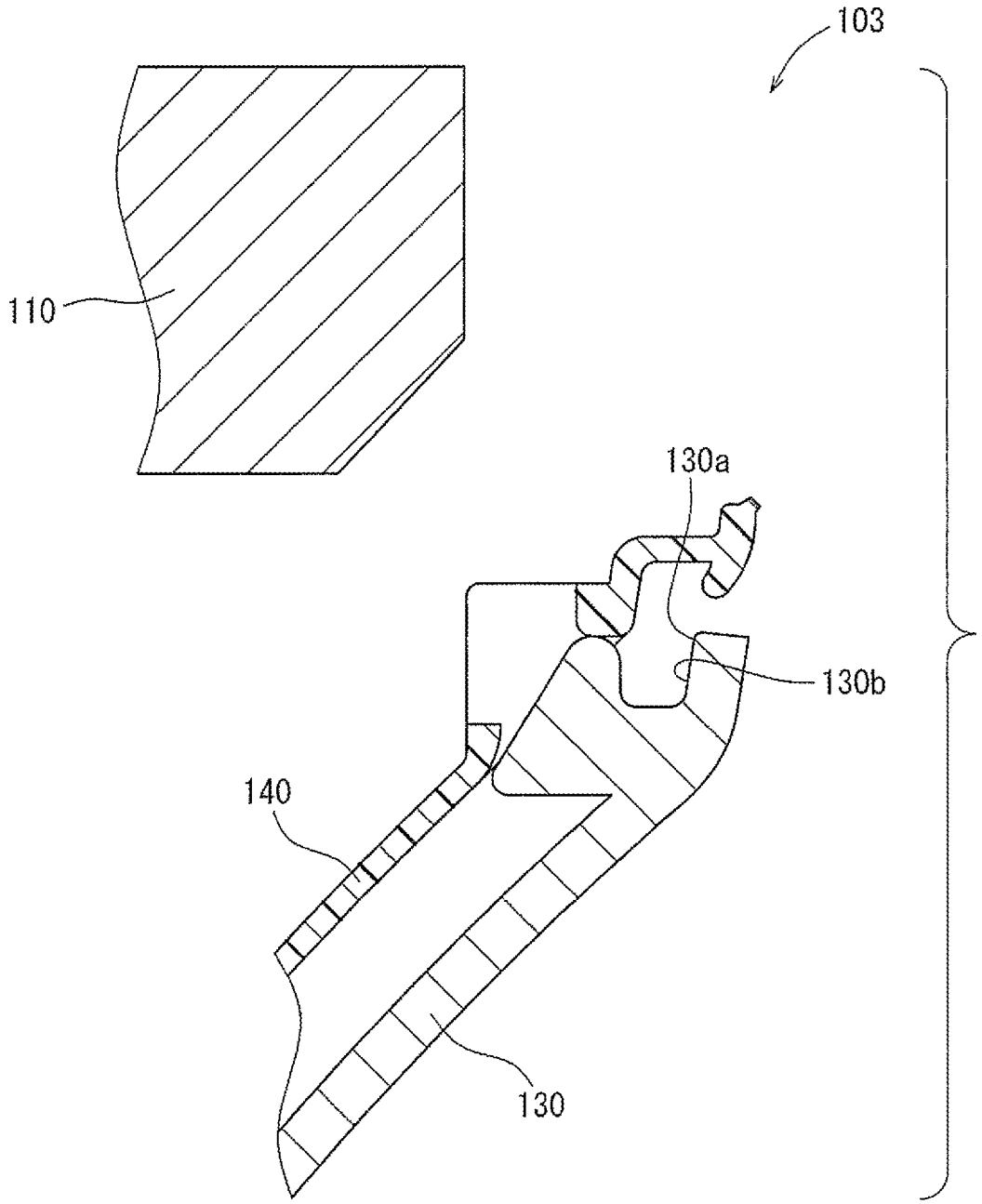
FIG. 19 PRIOR ART
FIG. 19 is a view similar to FIG. 10, which shows a condition in which a pad is displaced with respect to an antenna cover in the completed stage of the first assembly operation.
Figure 20:
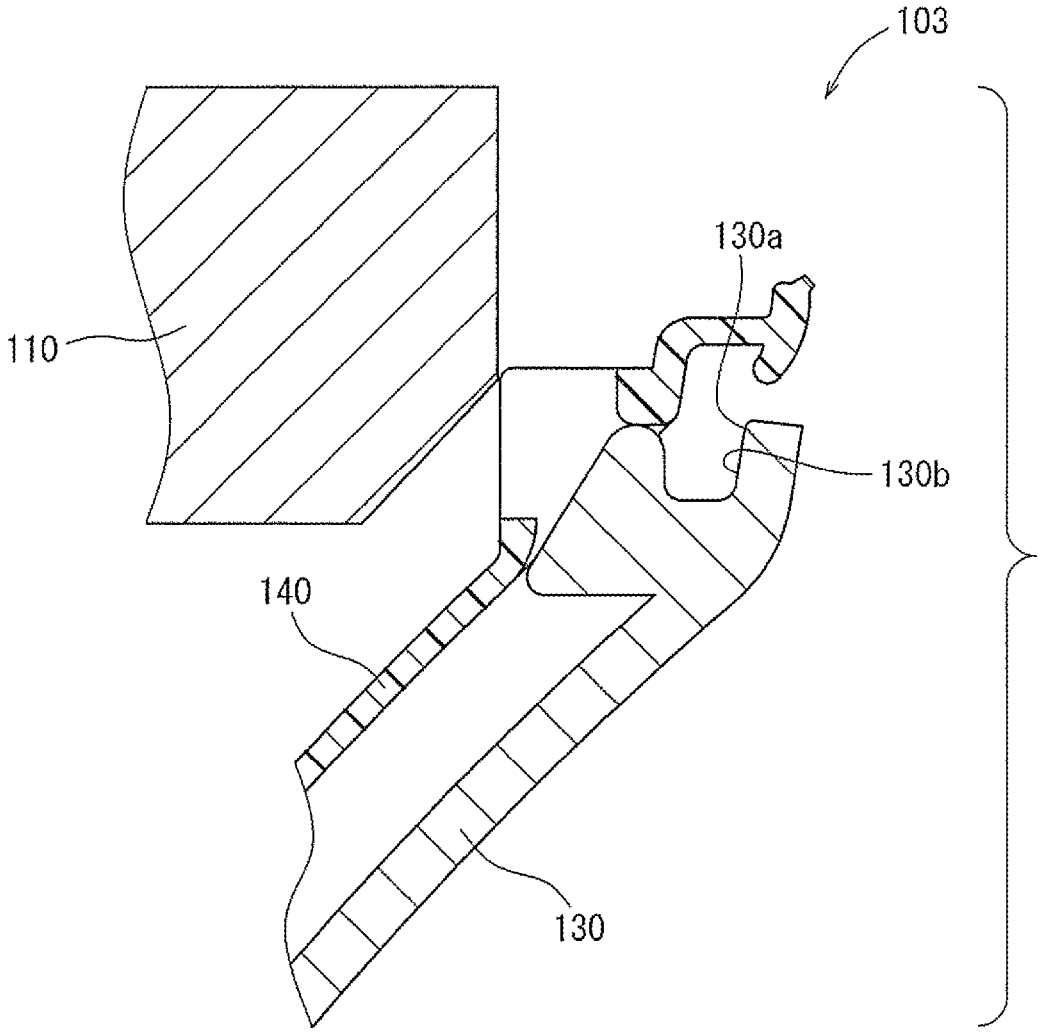
FIG. 20 PRIOR ART
FIG. 20 is a view corresponding to FIG. 11, which shows the initial stage of the second assembly operation.
Figure 21:
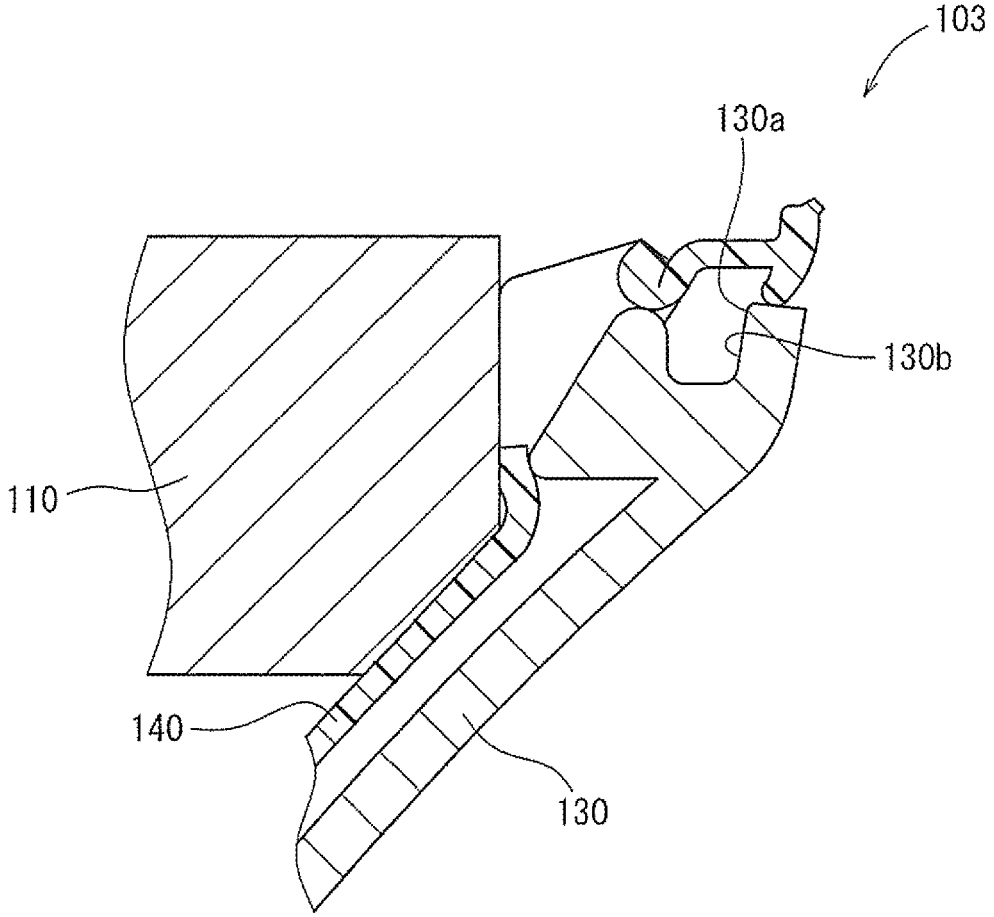
FIG. 21 PRIOR ART
FIG. 21 is a view corresponding to FIG. 13, which shows the completed stage of the second assembly operation.

Generally, these two assembly operations are performed by hand while the antenna cover 130 is held by one hand of a worker. Therefore, when the second operation is performed, the opening periphery 130*a* of the antenna cover 130 may be excessively pressed by the fingers of the hand, so as to be partially flexed inward. As a result, as shown in FIG. 19, the elastomer pad 140 may be partially dislocated or displaced with respect to the antenna cover 130. Therefore, as shown in FIGS. 20 and 21, the antenna unit 110 may be attached to the antenna cover 130 while the elastomer pad 140 is incompletely attached to the antenna cover 130. This may lead to the flawed antenna device 103. Accordingly, there is a need in the art for an improved vehicular antenna device.

A representative embodiment will now be described in detail with reference to FIGS. 1 to 13.

Figure 8:
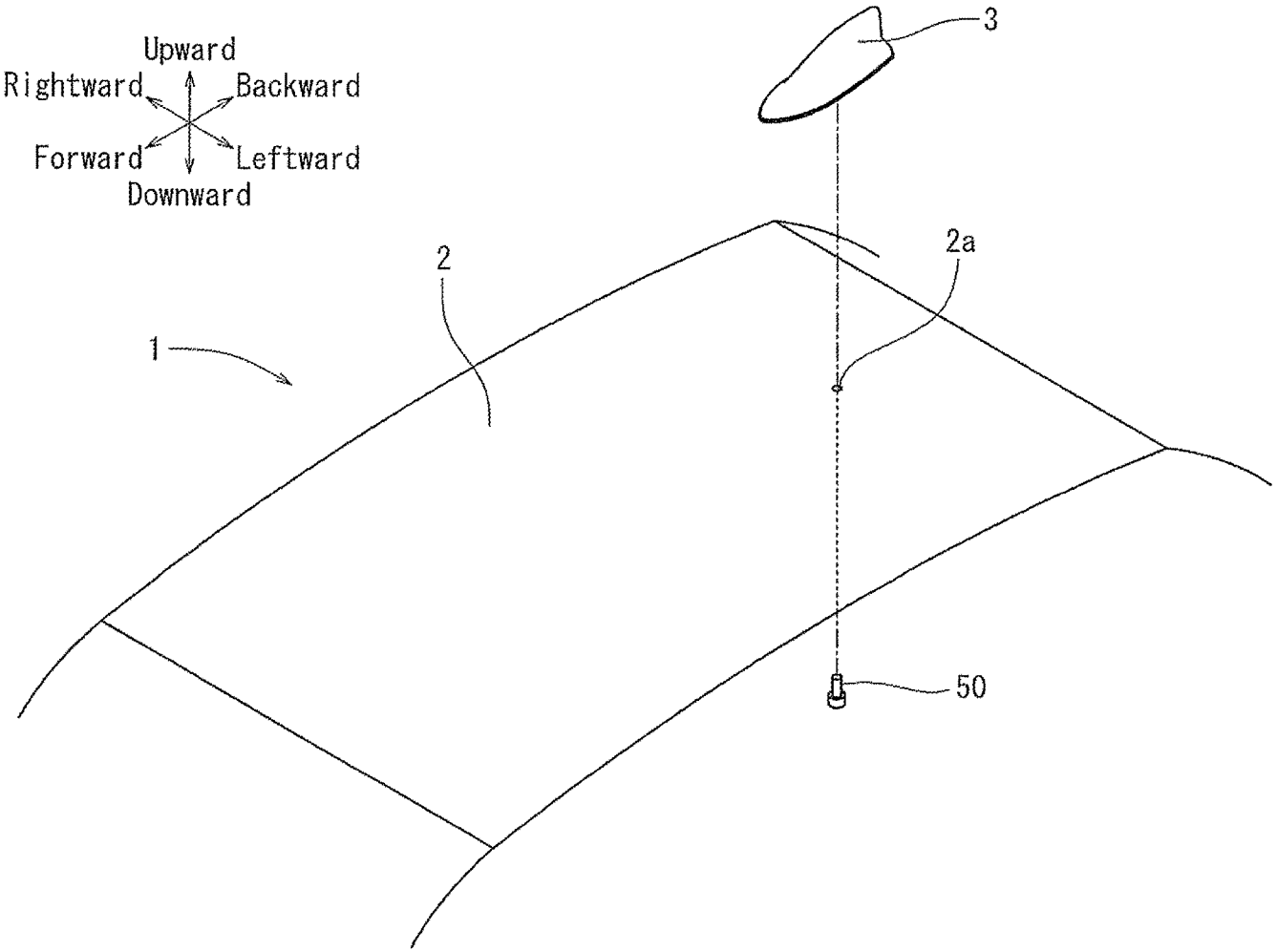
FIG. 8 is a perspective view of the antenna device, which shows a method of attaching the antenna device to a roof of a vehicle.
Figure 9:
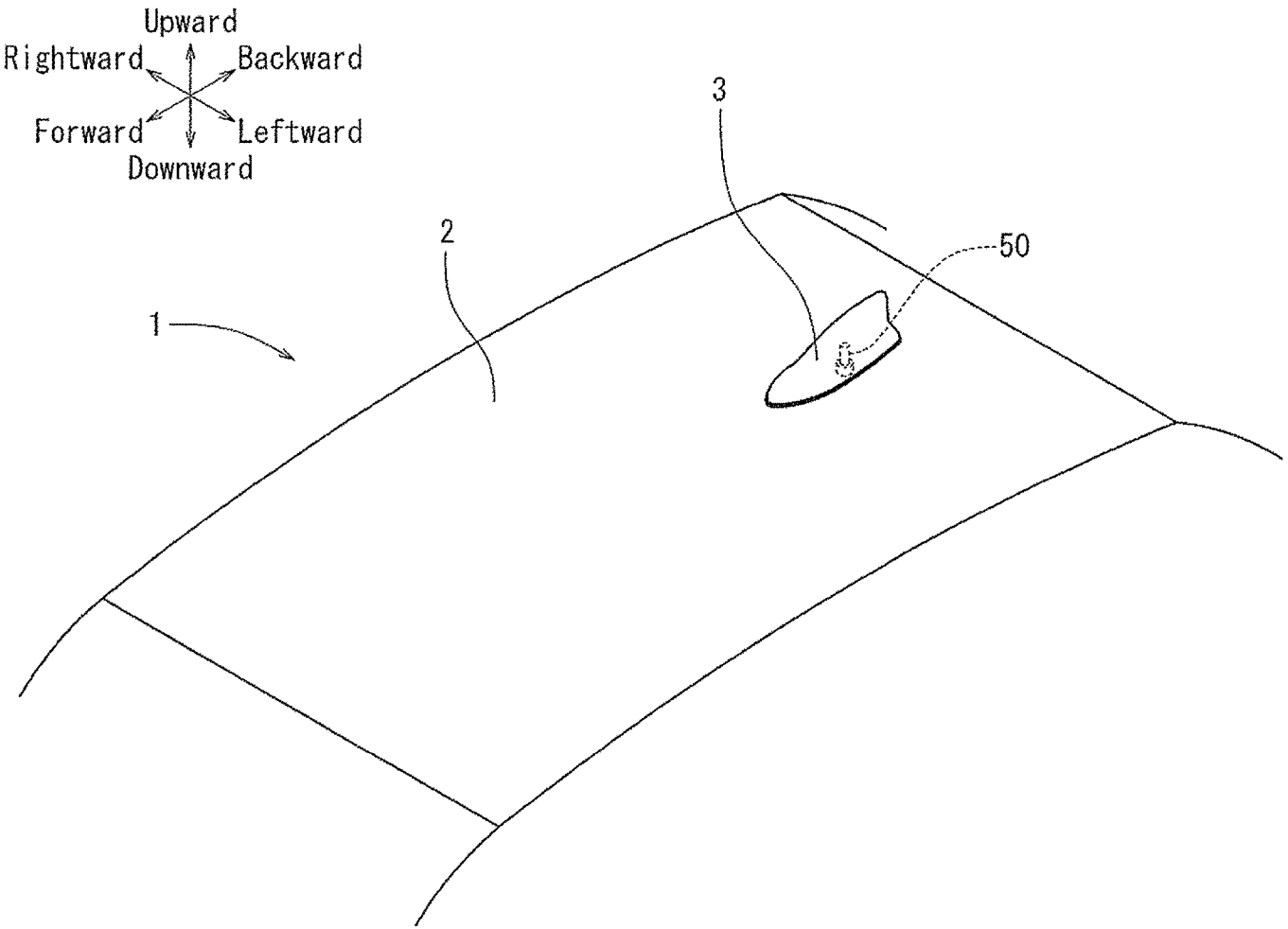
FIG. 9 is a perspective view of the antenna device, which shows a condition in which the antenna device is attached to the roof of the vehicle.

In this embodiment, an automobile (passenger car) 1 may be exemplified as a vehicle to which a vehicular antenna device 3 is attached (FIGS. 8 and 9). Further, forward and backward, rightward and leftward, and upward and downward in the drawings respectively correspond to forward and backward, rightward and leftward, and upward and downward of the automobile 1, which are identified in the drawings.

Figure 2:
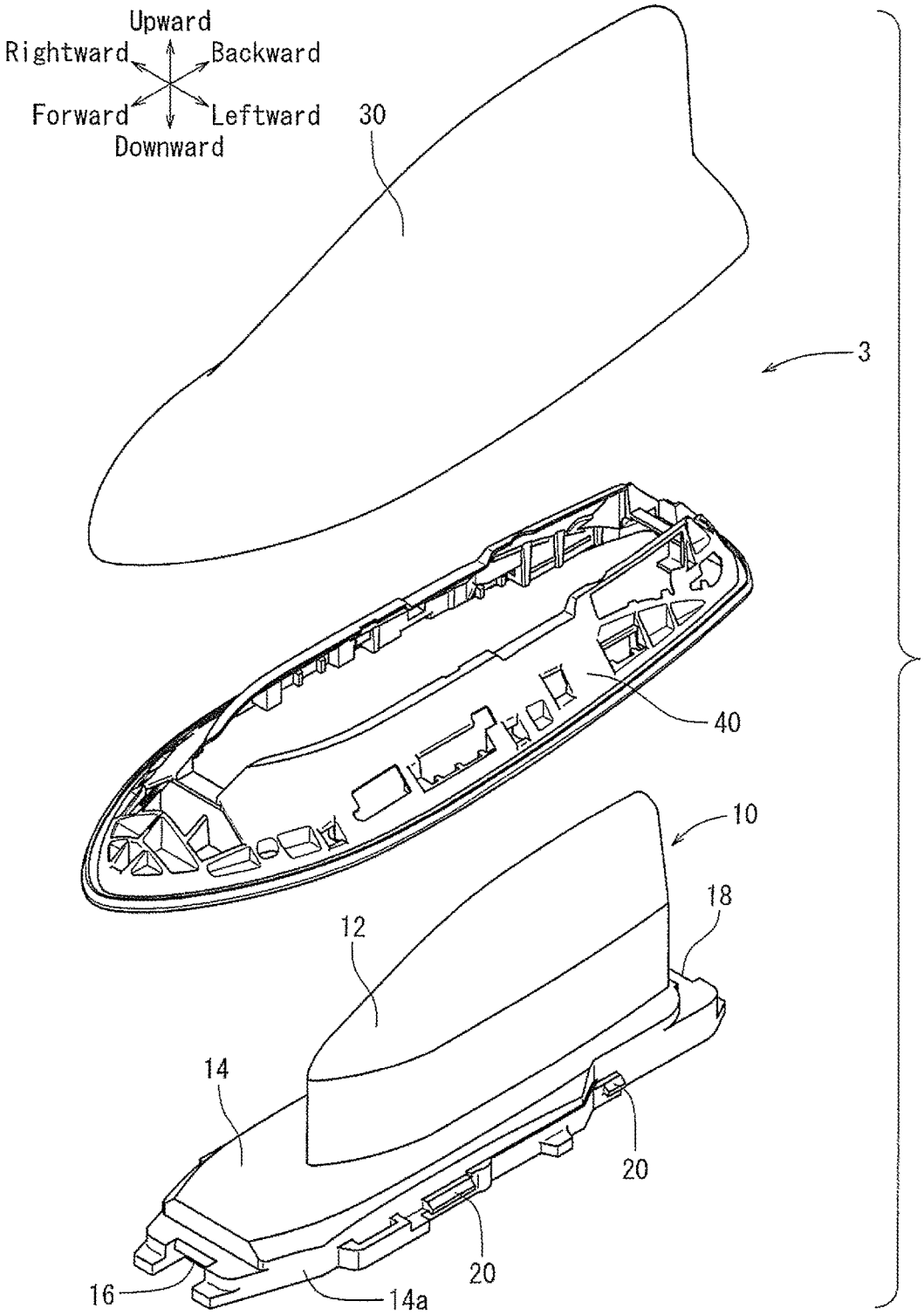
FIG. 2 is an exploded perspective view of the antenna device, which is viewed from above.
Figure 3:
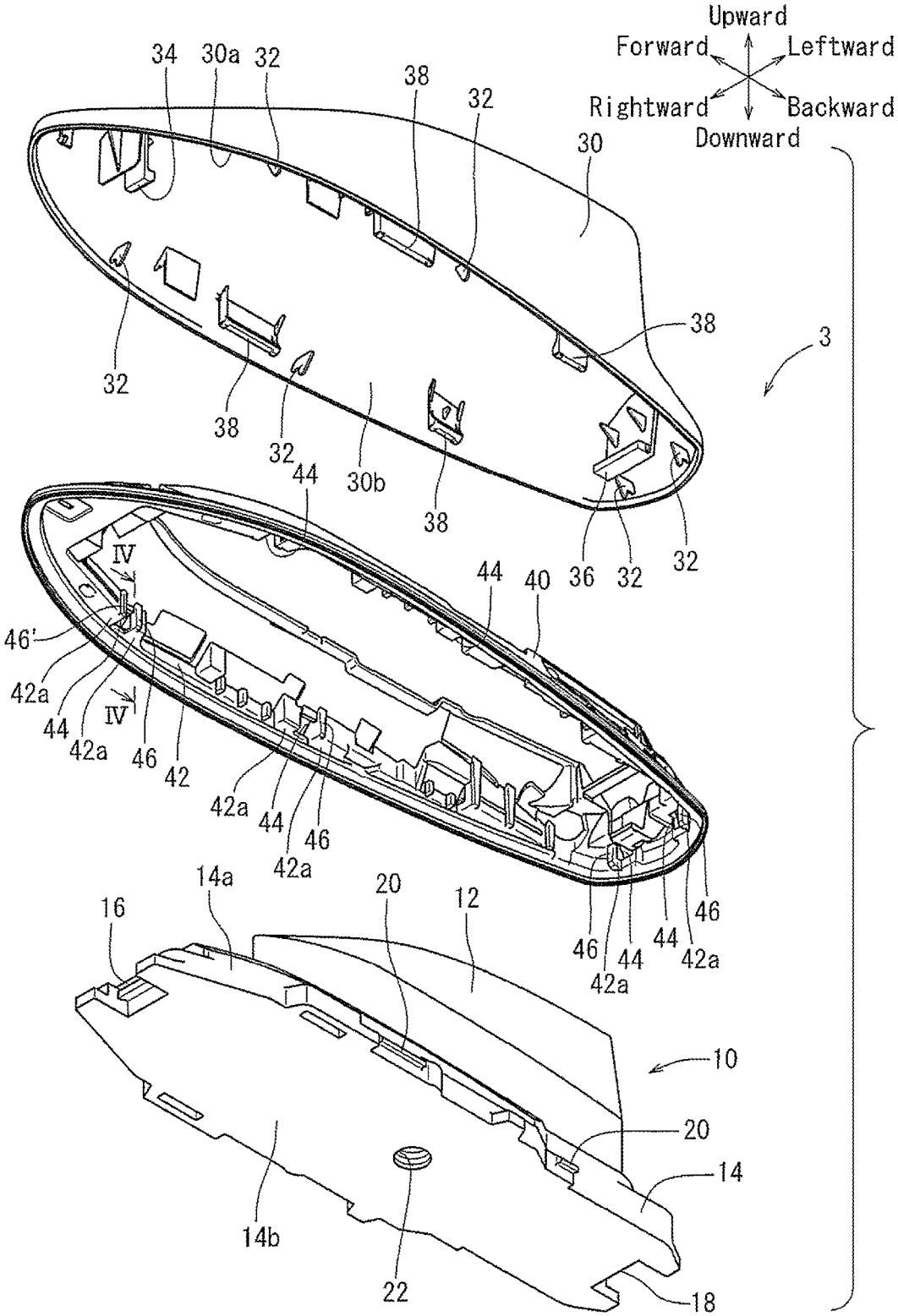
FIG. 3 is an exploded perspective view of the antenna device, which is viewed from below.

As shown in FIGS. 1 to 3, the vehicular antenna device 3 (which will be hereinafter simply referred to as the antenna device 3) includes an antenna unit 10, an antenna cover 30, and a pad 40. The antenna unit 10 may be composed of an antenna element 12 configured to transmit and receive various electromagnetic waves or signals (e.g., radio broadcasting signals, television broadcasting signals, GPS signals, cell-phone signals, signals from ETC device), and an antenna substrate 14 having various electrical circuits (not shown) electrically connected to the antenna element 12.

As shown in FIGS. 2 and 3, the antenna substrate 14 of the antenna unit 10 may have a main engagement portion 16 formed in a front side of an outer periphery 14*a* thereof. The antenna substrate 14 may also have an auxiliary engagement portion 18 formed in a back side of the outer periphery 14*a* thereof. The antenna substrate 14 may have two pairs of (front and back) engagement claws 20 respectively formed in lateral (right and left) sides of the outer periphery 14*a* thereof. Each pair of engagement claws 20 may be positioned at a certain interval in a front-back direction. Further, the antenna substrate 14 may have a threaded bore 22 formed therein, which may be used to attach the antenna device 3 to a roof 2 (FIGS. 8 and 9) of the automobile 1. The threaded bore 22 may be opened in a bottom surface 14*b* of the antenna substrate 14.

As shown in FIG. 3, the antenna cover 30 may be a shark fin-shaped hollow member having an opening formed in a bottom portion thereof. That is, the antenna cover 30 may be an open-bottomed streamline-shaped hollow member that is gradually widened and raised front-to-back. The antenna cover 30 may have an internal space that is configured to receive or encapsulate the antenna unit 10.

As shown in FIG. 3, the antenna cover 30 may have an opening periphery 30*a* that defines the opening thereof. Further, the antenna cover 30 may have three (first to third) pairs of engagement strips 32 (which may also be referred to as first engagement elements) formed in an inner peripheral surface 30*b* of the opening periphery 30*a*. The first pair of engagement strips 32 may be formed in a back side of the inner peripheral surface 30*b*, so as to be positioned at a certain interval in a lateral direction. Each of the second and third pairs of engagement strips 32 may be formed in each of lateral (right and left) sides of the inner peripheral surface 30*b*, so as to be positioned at a certain interval in the front-back direction. Further, the antenna cover 30 may have a main engagement claw 34 formed in a front side of an interior surface thereof. The main engagement claw 34 may be arranged and constructed to flexibly engage the main engagement portion 16 of the antenna unit 10 when the antenna unit 10 is pressed into the antenna cover 30 (which will be hereinafter described).

As shown in FIG. 3, the antenna cover 30 may further have an engagement block 36 formed in a back side of the interior surface thereof. The engagement block 36 may be arranged and constructed to engage the auxiliary engagement portion 18 of the antenna unit 10 when the antenna unit 10 is pressed into the antenna cover 30. Further, the antenna cover 30 may have two pairs of (front and back) auxiliary engagement portions 38 formed in lateral (right and left) sides, respectively, of the interior surface thereof. Each pair of auxiliary engagement portions 38 may be arranged and constructed to engage the corresponding engagement claws 20 of the antenna unit 10 when the antenna unit 10 is pressed into the antenna cover 30. Further, the antenna cover 30 may preferably be integrally formed of hard or rigid synthetic resins.

As shown in FIG. 3, the pad 40 may have a substantially annular shape and may be configured to conform to the inner peripheral surface 30*b* of the opening periphery 30*a* of the antenna cover 30. The pad 40 may function as a sealing member between the antenna cover 30 and the roof 2 of the automobile 1 when the antenna device 3 is attached to the roof 2 (which will be hereinafter described). The pad 40 may preferably be integrally formed of soft or elastic synthetic resins (e.g., rubber or elastomer).

As shown in FIG. 3, the pad 40 may have three (first to third) pairs of (vertical) engagement slots 44 (which may also be referred to as second engagement elements) formed in a peripheral wall 42 thereof. Further, the engagement slots 44 may preferably be formed in the peripheral wall 42 of the pad 40 so as to be positioned between guide blocks 42*a* formed in an inner surface of the peripheral wall 42. The first pair of engagement slots 44 may be formed in a back side of the peripheral wall 42 of the pad 40. The first pair of engagement slots 44 may be arranged and constructed to engage the first pair of engagement strips 32 formed in the back side of the inner peripheral surface 30*b* of the antenna cover 30 when the pad 40 is fitted in the antenna cover 30 (which will be hereinafter described). Further, the second and third pairs of engagement slots 44 may respectively be formed in lateral (right and left) sides of the peripheral wall 42 of the pad 40. The second and third pairs of engagement slots 44 may be arranged and constructed to engage the second and third pairs of engagement strips 32, respectively, formed in the right and left sides of the inner peripheral surface 30*b* of the antenna cover 30 when the pad 40 is fitted in the antenna cover 30.

Figure 4:
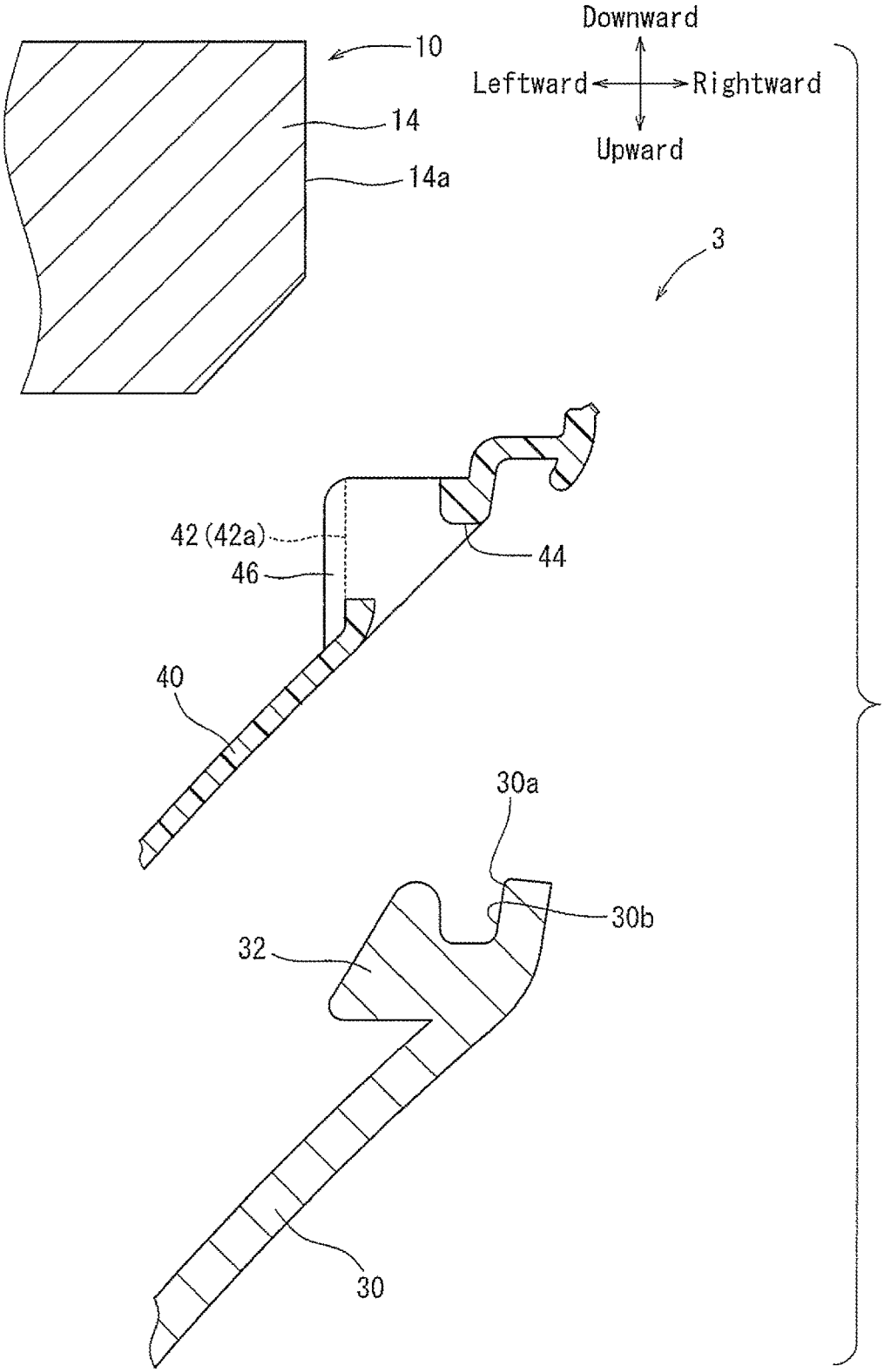
FIG. 4 is an enlarged cross-sectional view taken along line IV-IV in FIG. 3, which is an explanatory view showing a preinitiation stage of a first assembly operation in an assembly process of the antenna device.

As shown in FIG. 3, the pad 40 may have three (first to third) pairs of pressure ribs (projections) 46. The pressure ribs 46 may be formed in the inner surface of the peripheral wall 42 of the pad 40 so as to correspond to the engagement slots 44. In particular, the pressure ribs 46 may be formed in the guide blocks 42*a* formed in the inner surface of the peripheral wall 42 of the pad 40. As best shown in FIG. 4, each of the pressure ribs 46 may be projected laterally inward from the inner surface of the peripheral wall 42 of the pad 40. In particular, each of the pressure ribs 46 may be projected laterally inward from an end surface of each of the corresponding guide blocks 42*a* formed in the inner surface of the peripheral wall 42 of the pad 40. Preferably, each of the first pair of pressure ribs 46 may preferably be positioned along and adjacent to one (outer) side edge of each of the first pair of engagement slots 44. Further, each of the second and third pairs of pressure ribs 46 may preferably be positioned along and adjacent to one (back) side edge of each of the first to third pairs of engagement slots 44.

Further, the pad 40 may have two supplemental pressure ribs 46' (one of which is shown). The supplemental pressure ribs 46' may be formed in the inner surface of the peripheral wall 42 of the pad 40. In particular, the supplemental pressure ribs 46' may be formed in two of the guide blocks 42*a* formed in the inner surface of the peripheral wall 42 of the pad 40. Similar to the pressure ribs 46, each of the supplemental pressure ribs 46' may be projected laterally inward from the inner surface of the peripheral wall 42 of the pad 40. In particular, each of the supplemental pressure ribs 46' may be projected laterally inward from an end surface of each of the two corresponding guide blocks 42*a* formed in the inner surface of the peripheral wall 42 of the pad 40. Preferably, each of the supplemental pressure ribs 46' may be positioned along and adjacent to the other (front) side edge of each of the front engagement slots 44 of the second and third pairs of engagement slots 44. That is, each of the front engagement slots 44 of the second and third pairs of engagement slots 44 may be provided with two pressure ribs (the pressure rib 46 and the supplemental pressure rib 46') that are positioned across each of the front engagement slots 44.

Figure 5:
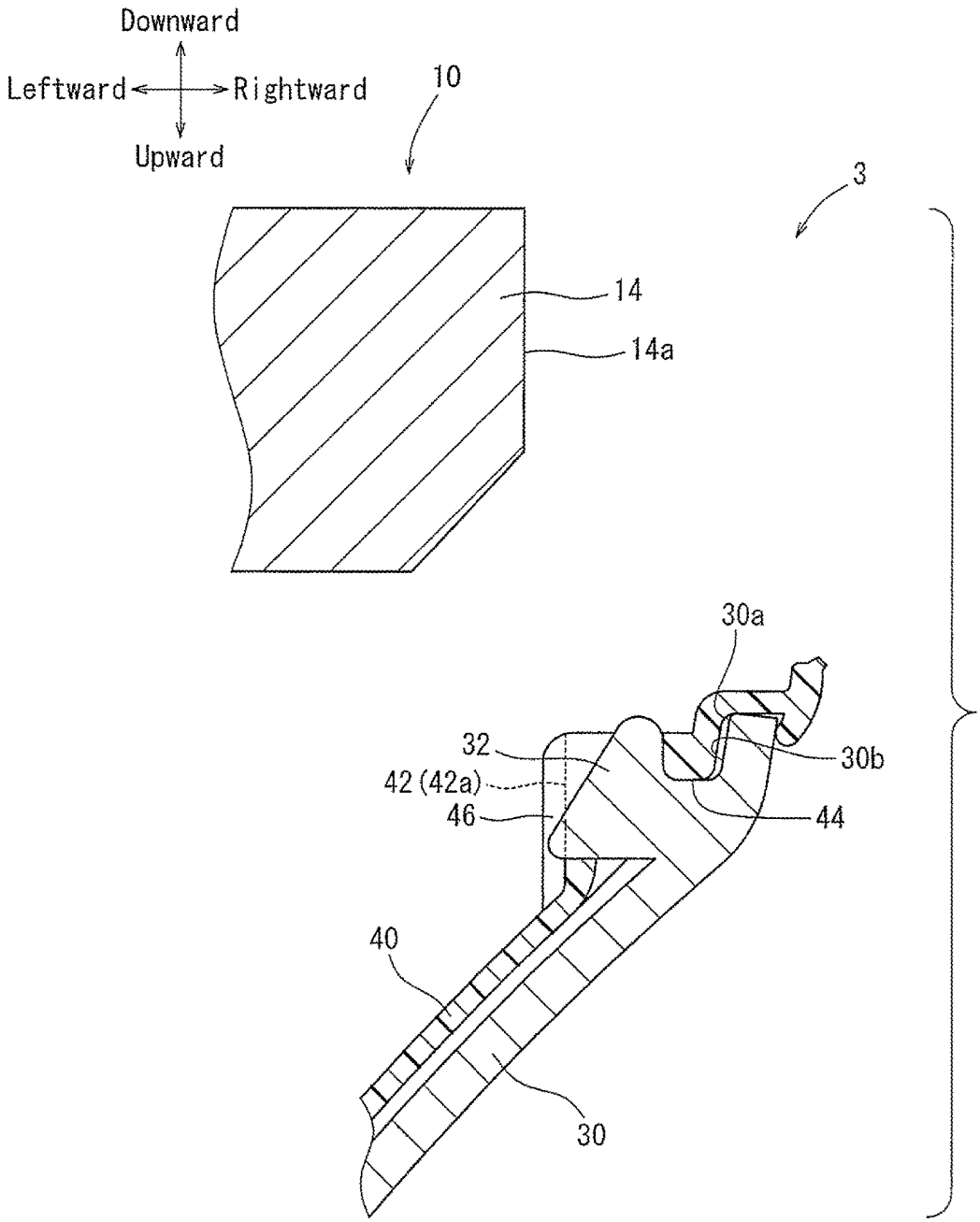
FIG. 5 is a view similar to FIG. 4, which shows a completed stage of the first assembly operation (e.g., before the second assembly operation is started)

An assembly process of the antenna device 3 composed of the antenna unit 10, the antenna cover 30 and the pad 40 will now be described with reference to FIGS. 4 to 7. First, as shown in FIG. 5, the pad 40 may be combined with the antenna cover 30. In particular, the pad 40 may be fitted in the inner peripheral surface 30*b* of the opening periphery 30*a* of the antenna cover 30 while the six engagement slots 44 formed in the peripheral wall 42 of the pad 40 respectively engage the six engagement strips 32 formed in the inner peripheral surface 30*b* of the opening periphery 30*a* of the antenna cover 30. Thus, the pad 40 may be attached to the antenna cover 30 while the pad 40 is held in a predetermined position relative to the antenna cover 30. This operation (i.e., an attaching operation of the pad 40 to the antenna cover 30) may be referred to as a first assembly operation or step. Further, as will be apparent from FIG. 5, in a condition in which the pad 40 is attached to the antenna cover 30 while the pad 40 is held in the predetermined position relative to the antenna cover 30, each of the pressure ribs 46 may be laterally protruded beyond a distal end of each of the engagement strips 32 engaging the engagement slots 44.

Figure 6:
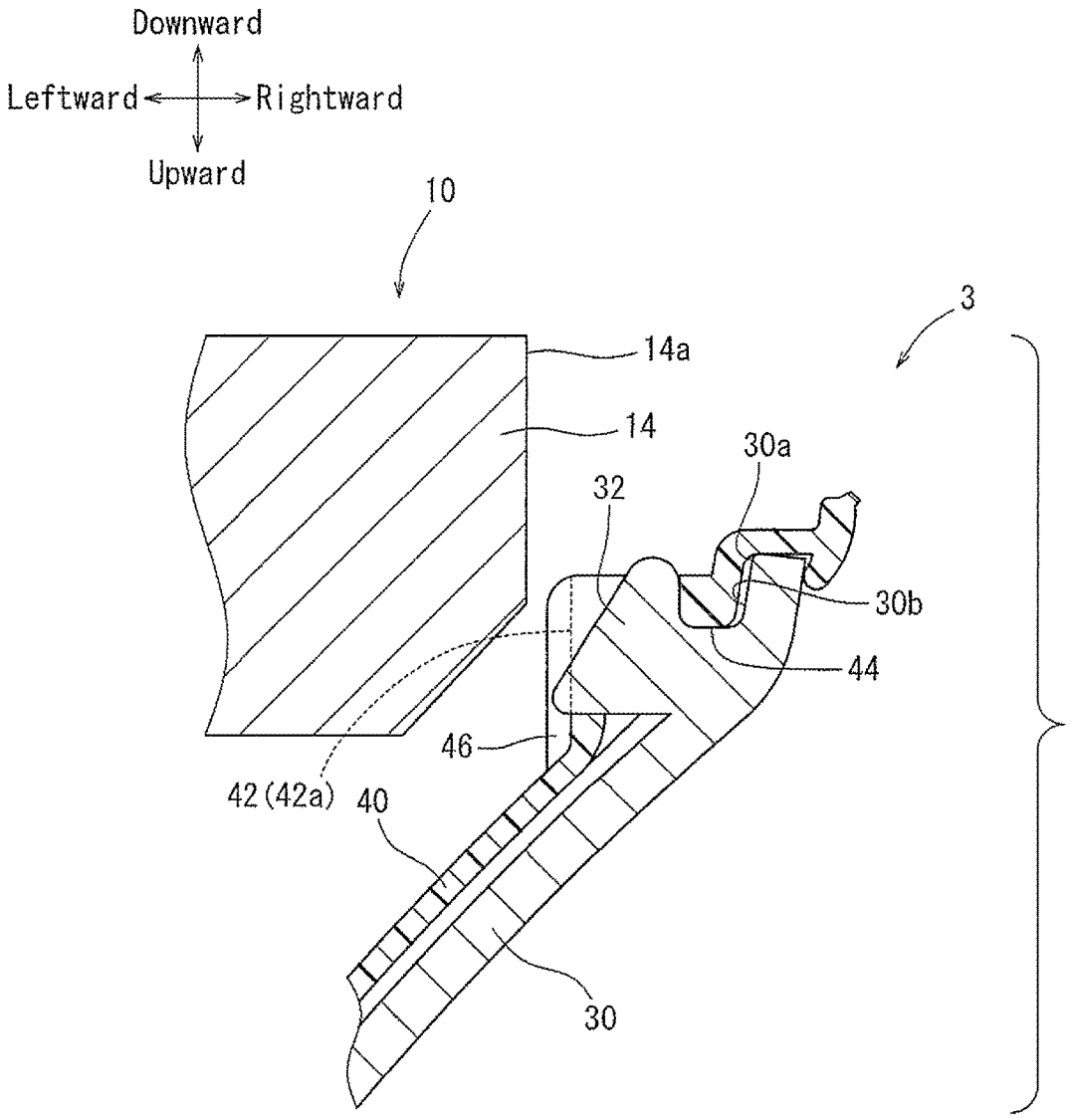
FIG. 6 is a view similar to FIG. 4, which shows an initial stage of a second assembly operation in the assembly process of the antenna device.
Figure 7:
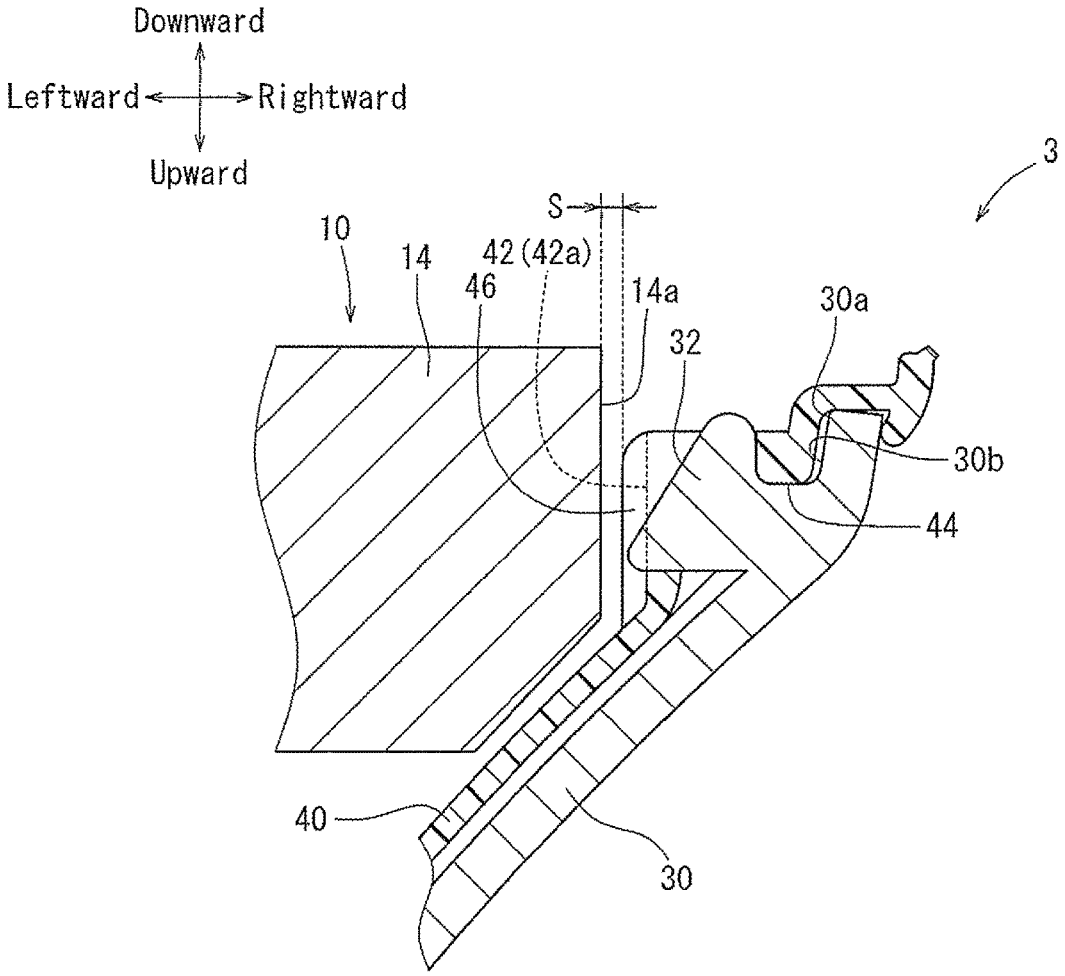
FIG. 7 is a view similar to FIG. 4, which shows a completed stage of the second assembly operation.

Next, as shown in FIGS. 6 and 7, in this condition, the antenna unit 10 may be attached to the antenna cover 30. In particular, the auxiliary engagement portion 18 formed in the antenna substrate 14 of the antenna unit 10 may be hooked on the engagement block 36 formed in the antenna cover 30, so as to form a pivotal engagement portion therein. Thereafter, the antenna unit 10 may be rotated with respect to the antenna cover 30 about the pivotal engagement portion until the (four) engagement claws 20 formed in the antenna substrate 14 of the antenna unite 10 respectively engage the (four) auxiliary engagement portions 38 formed in the antenna cover 30. Upon rotation of the antenna unit 10, the antenna unit 10 may be pressed against the antenna cover 30, so that the main engagement claw 34 formed in the antenna cover 30 may engage the main engagement portion 16 of the antenna unit 10. Thus, the antenna unit 10 may be attached to the antenna cover 30 with the pad 40 interleaved therebetween, so that the antenna device 3 may be assembled. This operation (i.e., an attaching operation of the antenna unit 10 to the antenna cover 30) may be referred to as a second assembly operation or step.

In the manner described, the antenna device 3 may be assembled through two assembly operations (the first and second assembly operations). Further, as shown in FIG. 7, in a condition in which the antenna device 3 is assembled (e.g., in a condition in which the antenna unit 10 is attached to the antenna cover 30 with the pad 40 disposed therebetween), a predetermined clearance S (0.2 mm to 0.6 mm, preferably 0.4 mm) may be formed between the outer periphery 14*a* of the antenna substrate 14 of the antenna unit 10 and the pressure ribs 46 formed in the pad 40.

As shown in FIGS. 8 and 9, the antenna device 3 thus assembled may be attached to the roof 2 of the automobile 1. In particular, the antenna device 3 may be positioned on the roof 2 while the threaded bore 22 formed in the antenna substrate 14 of the antenna unit 10 is aligned with an attachment hole 2*a* previously formed in the roof 2. Subsequently, a fastening bolt 50 may be inserted into the attachment hole 2*a* from an interior side of the roof 2 and then be screwed or threaded into the threaded bore 22. Thus, the fastening bolt 50 may be fastened to the threaded bore 22 through the attachment hole 2*a*, so that the antenna device 3 may be fixed or secured to the roof 2.

Figure 10:
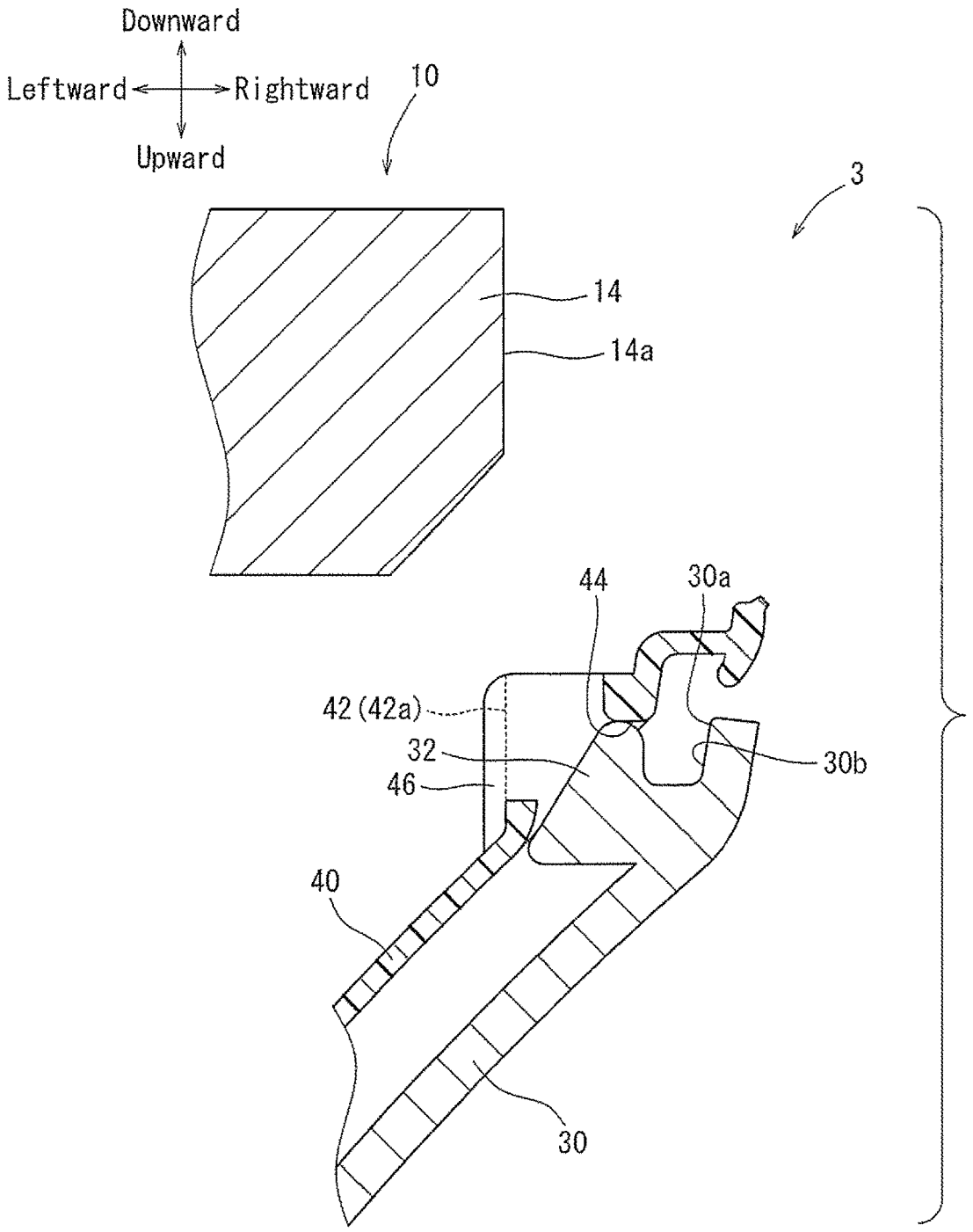
FIG. 10 is a view corresponding to FIG. 5, which shows a condition in which a pad is displaced with respect to an antenna cover in the completed stage of the first assembly operation.

Generally, the two assembly operations may be performed by hand while the antenna cover 30 is held by one hand of a worker. Therefore, when the second operation is performed, the opening periphery 30*a* of the antenna cover 30 may be pressed by the fingers of the hand, so as to be partially flexed inward. As a result, as shown in FIG. 10, the pad 40 combined with the antenna cover 30 may be partially inwardly dislocated or displaced from the predetermined position relative to the antenna cover 30. That is, the engagement slots 44 formed in the peripheral wall 42 of the pad 40 may be removed or disengaged from the engagement strips 32 formed in the inner peripheral surface 30*b* of the opening periphery 30*a* of the antenna cover 30. This means that the pad 40 may not be held in the predetermined position relative to the antenna cover 30.

Figure 11:
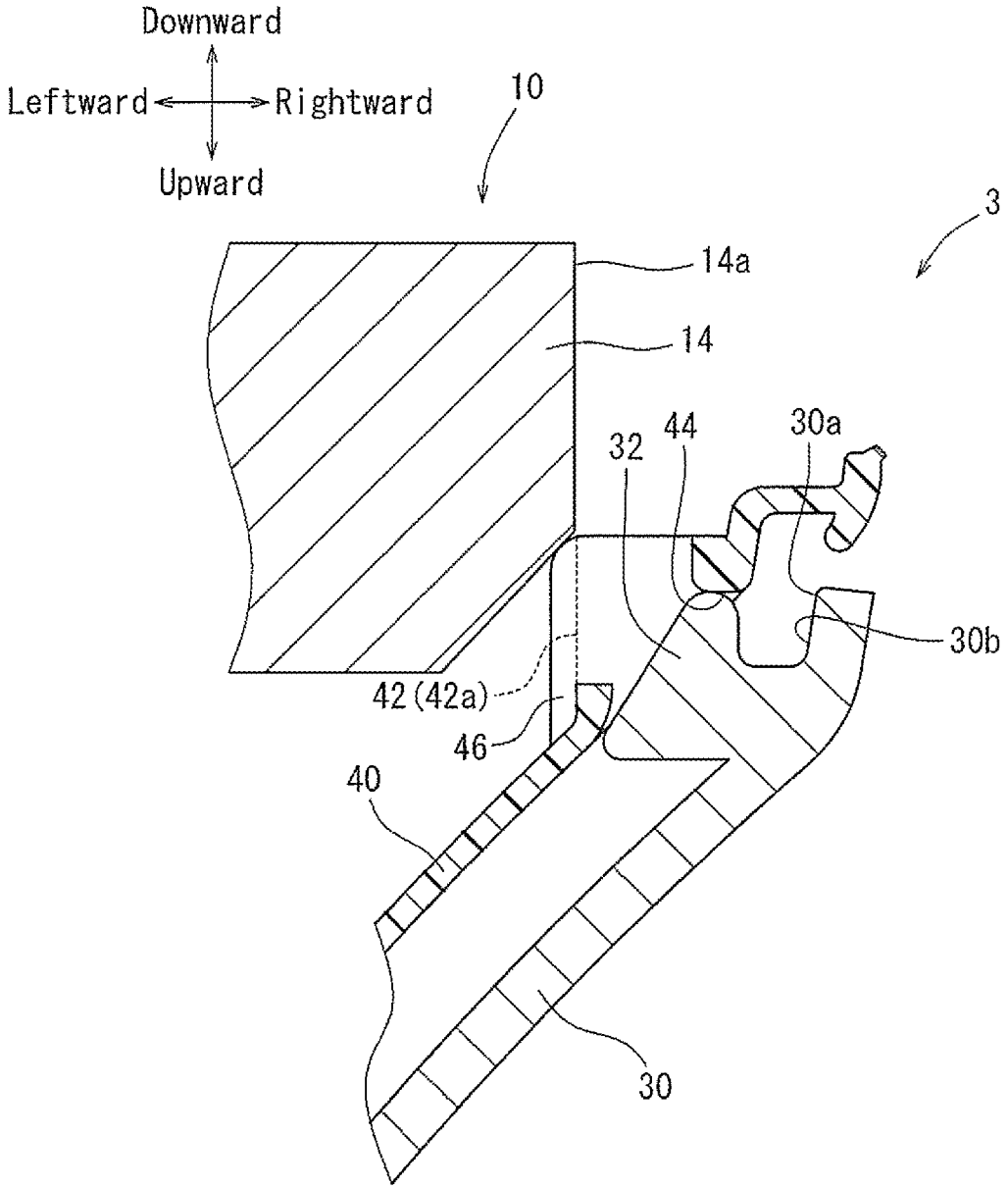
FIG. 11 is a view corresponding to FIG. 6, which shows the initial stage of the second assembly operation.
Figure 12:
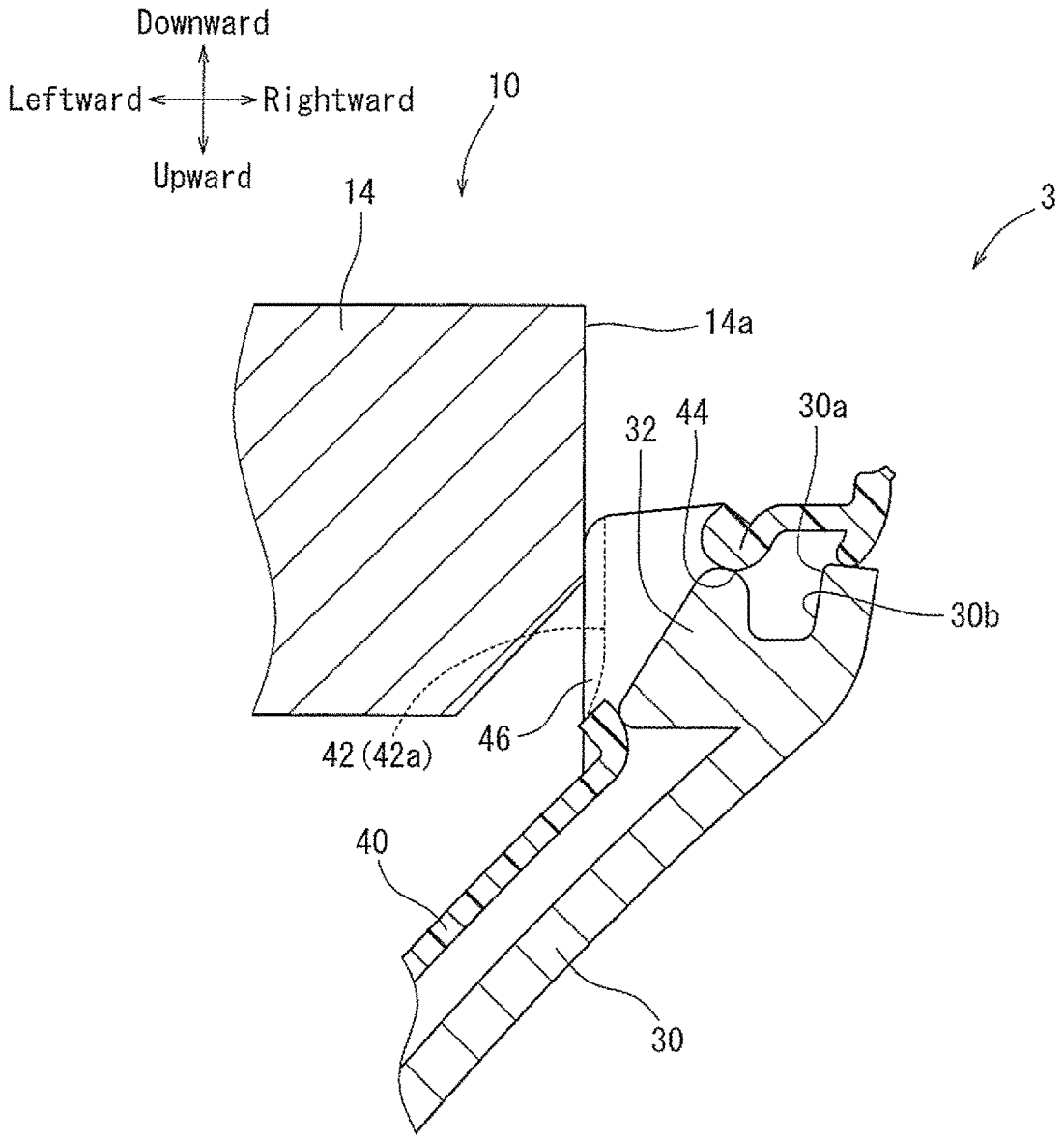
FIG. 12 is an explanatory view which shows a stage before the second assembly operation is completed.
Figure 13:
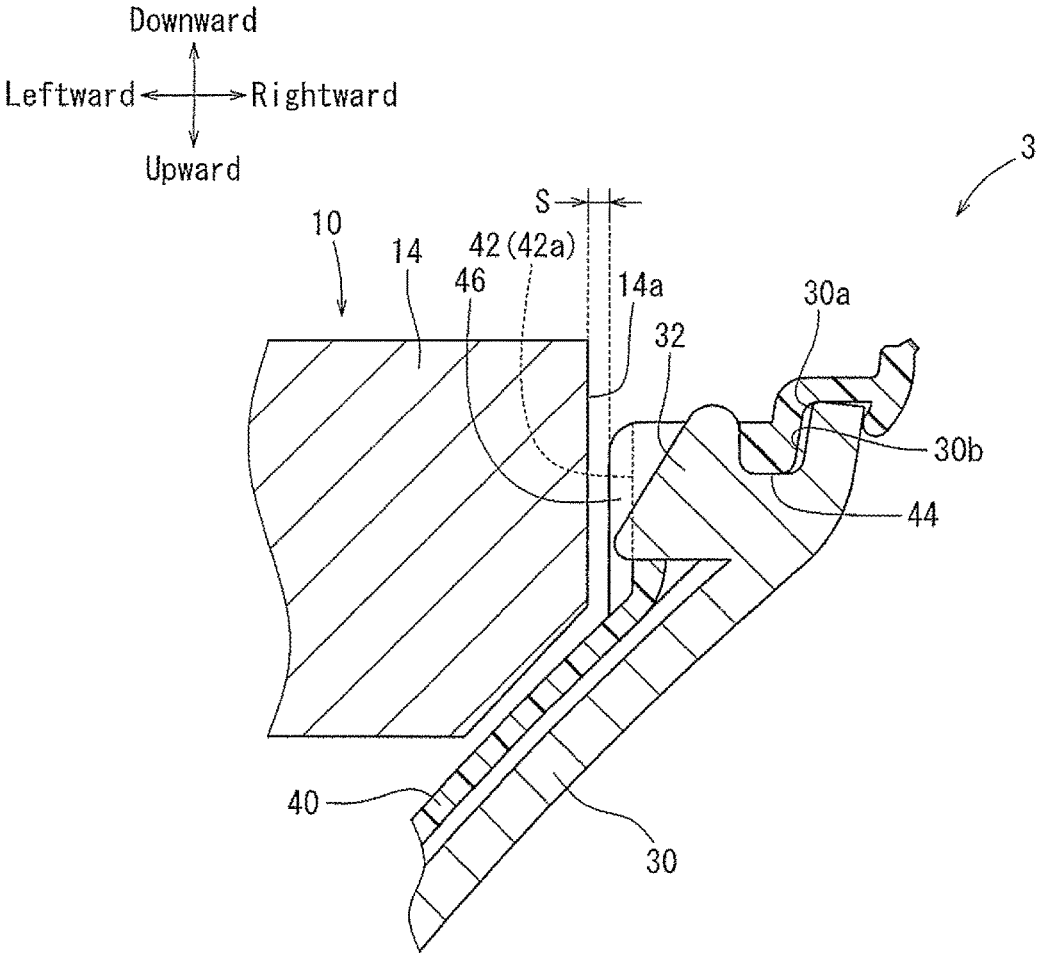
FIG. 13 is a view corresponding to FIG. 7, which shows the completed stage of the second assembly operation.

In this condition, when the antenna unit 10 may be pressed against the antenna cover 30 in the same manner as described above in order to attach the antenna unit 10 to the antenna cover 30, the pressure ribs 46 (the supplemental pressure ribs 46') formed in the pad 40 may be pressed by the outer periphery 14*a* of the antenna substrate 14 of the antenna unit 10 (FIG. 11). That is, the antenna unit 10 may be pressed against the antenna cover 30 while pressing back the pad 40 against the antenna cover 30 (FIG. 12). As a result, the antenna unit 10 may be attached to the antenna cover 30 while the engagement slots 44 of the pad 40 may engage the engagement strips 32 of the antenna cover 30 again (FIG. 13). In other words, the antenna unit 10 may be attached to the antenna cover 30 while the pad 40 may be held in the predetermined position relative to the antenna cover 30.

According to the antenna device 3 of the present embodiment, the pad 40 may have the pressure ribs 46 (the supplemental pressure ribs 46') formed in the peripheral wall 42 thereof. Therefore, even if the pad 40 attached to the antenna cover 30 may be partially inwardly displaced with respect to the antenna cover 30, when the antenna unit 10 may be pressed against the antenna cover 30 in order to attach the antenna unit 10 to the antenna cover 30, the pressure ribs 46 (the supplemental pressure ribs 46') may be pressed by the outer periphery 14*a* of the antenna substrate 14 of the antenna unit 10. Thus, the pad 40 may be pressed back against the antenna cover 30, so as to be held in the predetermined position relative to the antenna cover 30. As a result, the antenna device 3 may be prevented from being assembled in a condition in which the pad 40 is partially displaced from the predetermined position relative to the antenna cover 30.

Further, the pressure ribs 46 may be positioned in proximity to the engagement slots 44. Therefore, the pad 40 may be effectively and reliably pressed back against the antenna cover 30 by the pressure ribs 46.

Further, the pad 40 may have the supplemental pressure ribs 46' in addition to the supplemental pressure ribs 46'. The supplemental pressure ribs 46' may function to further effectively and reliably press back the pad 40 against the antenna cover 30.

The antenna unit 10, the antenna cover 30 and the pad 40 may be arranged and constructed such that the predetermined clearance S may be formed between the outer periphery 14*a* of the antenna substrate 14 of the antenna unit 10 and the pressure ribs 46 formed in the pad 40 in a condition in which assembly of the antenna device 3 is completed. Therefore, when the antenna unit 10 may be pressed against the antenna cover 30, the outer periphery 14*a* of the antenna substrate 14 of the antenna unit 10 may be effectively prevented from interfering with the pressure ribs 46 formed in the pad 40.

Thus, the antenna device 3 of the present embodiment may be easily and reliably assembled without using a specialized tool or jig.

Various changes and modifications may be made to the present embodiment without departing from the scope of the teaching. For example, in the embodiment, the automobile 1 may be exemplified as the vehicle to which the antenna device 3 is attached. However, the antenna device 3 may be attached to various vehicles.

Further, in the embodiment, an engaging mechanism composed of the engagement slots 44 and the engagement strips 32 may be used in order to attach the pad 40 to the antenna cover 30. However, such an engaging mechanism may be replaced with various engaging mechanisms (e.g., an engaging mechanism composed of engagement projections and engagement hooks).

Further, in the embodiment, an engaging mechanism composed of a combination of the auxiliary engagement portion 18 and the engagement block 36, a combination of the engagement claws 20 and the auxiliary engagement portions 38, and a combination of the main engagement portion 16 and the main engagement claw 34 may be used in order to attach the antenna unit 10 to the antenna cover 30. However, such an engaging mechanism may be replaced with various engaging mechanisms.

Further, the number and the numeral value described therein may be changed as necessary.

A representative example of the present teaching has been described in detail with reference to the attached drawings. This detailed description is merely intended to teach a person of skill in the art further details for practicing preferred aspects of the present teaching and is not intended to limit the scope of the teaching. Only the claims define the scope of the claimed teaching. Therefore, combinations of features and steps disclosed in the foregoing detailed description may not be necessary to practice the teaching in the broadest sense, and are instead taught merely to particularly describe detailed representative examples of the teaching. Moreover, the various features taught in this specification may be combined in ways that are not specifically enumerated in order to obtain additional useful embodiments of the present teaching.

What is claimed is:

1. A vehicular antenna device, comprising:

an antenna unit configured to transmit and receive electromagnetic waves or signals;

an antenna cover configured to cover the antenna unit; and a pad configured to be attached to an inner peripheral surface of the antenna cover, wherein the antenna unit is configured to be attached to the antenna cover with the pad disposed therebetween, wherein the pad includes a plurality of pressure ribs formed in an inner surface of a peripheral wall thereof, and wherein the pressure ribs are configured to be pressed by the antenna unit being attached to the antenna cover in a condition in which the pad is partially displaced from a predetermined position relative to the antenna cover before the antenna unit is attached to the antenna cover.

2. The vehicular antenna device as defined in claim 1, wherein the pad includes a plurality of engagement slots formed in the peripheral wall thereof and configured to engage with a plurality of engagement strips formed in the antenna cover, and wherein each of the pressure ribs is positioned adjacent to a first side edge of each of the engagement slots.

3. The vehicular antenna device as defined in claim 2, wherein the pad includes at least one supplemental pressure rib formed in the inner surface of the peripheral wall thereof, and wherein the at least one supplemental pressure rib is positioned adjacent to a second side edge of at least one of the engagement slots.

4. The vehicular antenna device as defined in claim 1, wherein in a condition in which the antenna unit is attached to the antenna cover with the pad disposed therebetween, a predetermined clearance is formed between an outer periphery of the antenna unit and the pressure ribs of the pad.

5. The vehicular antenna device as defined in claim 2, wherein each engagement slot is positioned between a pair of guide blocks formed in the inner surface of the peripheral wall of the pad, and wherein each pressure rib is formed in one of the guide blocks.

6. A vehicular antenna device, comprising:

an antenna unit;

an antenna cover including engagement strips formed therein; and a pad including a plurality of engagement slots and a plurality of pressure ribs formed therein, wherein the engagement strips and the engagement slots engage each other to attach the pad to the antenna cover, and wherein each of the pressure ribs protrudes beyond a distal end of each of the engagement strips in a condition in which the pad is attached to the antenna cover while the pad is held in a predetermined position relative to the antenna cover.

* * * * *